US005682194A

United States Patent [19]

Uyttendaele et al.

[11] Patent Number: 5,682,194

[45] Date of Patent: Oct. 28, 1997

[54] DIRECT THERMAL IMAGING

[75] Inventors: Carlo Alfons Uyttendaele, Mortsel; Robert Cyriel Van Haute, Temse; Bartholomeus Cyriel Horsten, Rumst; Luc Herwig Leenders, Herentals, all of Belgium

[73] Assignee: Agfa-Gevaert N.V., Mortsel, Belgium

[21] Appl. No.: 428,075

[22] PCT Filed: Dec. 8, 1993

[86] PCT No.: PCT/EP93/03471

§ 371 Date: Apr. 25, 1995

§ 102(e) Date: Apr. 25, 1995

[87] PCT Pub. No.: WO94/14618

PCT Pub. Date: Jul. 7, 1994

[30] Foreign Application Priority Data

Dec. 18, 1992 [EP] European Pat. Off. ..... 92204008

[51] Int. Cl.[6] ..... B41M 5/26

[52] U.S. Cl. ..... 347/221; 347/171

[58] Field of Search ..... 347/212, 171, 347/221; 346/135.1; 503/227; 430/348, 349

[56] References Cited

U.S. PATENT DOCUMENTS

| | | | |
|---|---|---|---|
| 3,996,397 | 12/1976 | Laridon et al. | 427/145 |
| 4,643,454 | 2/1987 | Ondis | 283/74 |
| 5,196,861 | 3/1993 | Fisher, Sr. | 347/212 |

*Primary Examiner*—Huan H. Tran

*Attorney, Agent, or Firm*—Brumbaugh, Graves, Donohue & Raymond

[57] ABSTRACT

A direct thermal imaging method wherein in conjunction with an information-wise energized thermal printhead a direct thermal recording material is used that contains on a support (i) a heat-sensitive layer comprising a substantially light insensitive organic silver salt, (ii) optionally an outermost anti-friction or protective layer, and (iii) a reducing agent being present in the heat-sensitive layer and/or another layer on the same side of the support carrying the heat-sensitive layer, characterized in that said method contains the step of information-wise heating said heat-sensitive layer through a contacting but removable protection element, e.g. web or sheet, wherefrom during said heating no transfer of imaging substance(s) to said heat-sensitive layer takes place.

9 Claims, 1 Drawing Sheet

DIRECT THERMAL IMAGING

FIELD OF THE INVENTION

The present invention relates to direct thermal imaging.

BACKGROUND OF THE INVENTION

In thermography two approaches are known:

1. Direct thermal formation of a visible image pattern by imagewise heating of a recording material containing matter that by chemical or physical process changes colour or optical density.

2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions of incorporated dye are transferred onto a contacting receiver element by the application of heat in a pattern normally controlled by electronic information signals.

The optical density of transparencies produced by the thermal transfer procedure is rather low and in most of the commercial systems—in spite of the use of donor elements specially designed for printing transparencies—only reaches 1 to 1.2 (as measured by a Macbeth Quantalog Densitometer Type TD 102). However, for many application fields a considerably higher transmission density is asked for. For instance in the medical diagnostical field a maximal transmission density of at least 2.5 is desired.

High optical densities can be obtained using a recording material comprising on a support a heat-sensitive layer comprising a substantially light insensitive organic silver salt and a reducing agent. Such material can be image-wise heated using a thermal head causing a reaction between the reducing agent and the substantially light insensitive organic silver salt leading to the formation of metallic silver. The density level may be controlled by varying the amount of heat applied to the recording material. This is generally accomplished by controlling the number of heat pulses generated by a thermal head. An image having a grey scale is thus obtained.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 in direct thermal printing signals are converted into electric pulses and then through a driver circuit selectively transferred to a thermal printhead. The thermal print head consists of microscopic heat resistor elements, which convert the electrical energy into heat via the Joule effect. The electric pulses thus converted into thermal signals manifest themselves as heat transferred to the surface of the thermal paper wherein the chemical reaction resulting in colour development takes place.

Heat-sensitive copying papers including a recording layer having a substantially light-insensitive organic silver salt and organic reducing agent in a thermoplastic binder such as polyvinyl acetate, polyvinyl butyral and cellulose nitrate (ref. Re 30,107 being reissue of U.S. Pat. No. 3,996,397) are less suited for use in thermographic recording operating with thermal printheads since these recording layers may stick to said printheads. Moreover, organic ingredients of the thermosensitive recording layer may exude by heat and may soil the thermal heads at an operating temperature in the range of 300° to 400° C. which are temperatures common in using thermal printheads. The undesirable transfer of said ingredients may be promoted by the pressure contact of the thermal head with the recording material, possible contact-pressures may be 200–500 g/cm$^2$ to ensure a good transfer of heat. The heating time per picture element (pixel) may be less than 1.0 ms.

Because of its high density the obtained silver image is in principal suitable for use as a medical diagnostic image. However the following problems have been encountered. Uneveness of density occurs with the number of images that have been printed and damaging of the heat sensitive layer occurs. These problems can be overcome by the presence of a protective layer on the heat-sensitive layer. Although this brings a substantial improvement so that the image may be suitable for some applications, the images may still show scratches that are prohibitive for the use of the image in medical diagnostics.

OBJECTS AND SUMMARY OF THE INVENTION

It is an object of the present invention to provide a direct thermal imaging method operating with a thermosensitive recording material in which a silver image can be formed by means of an information-wise energized thermal printhead, wherein during recording direct contact of the thermal printhead with the heat-sensitive layer of said recording material does not take place and thereby uneven image-formation, scratches and sticking of the heat-sensitive layer to the thermal printhead are avoided and soiling of the thermal printhead by substances of the heat-sensitive layer is prevented.

Other objects and advantages of the present invention will appear from the further description and illustrative drawing.

According to the present invention a direct thermal imaging method is provided wherein in conjunction with an information-wise energized thermal printhead a direct thermal recording material is used that contains on a support (i) a heat-sensitive layer comprising a substantially light insensitive organic silver salt, (ii) optionally an outermost anti-friction or protective layer, and (iii) a reducing agent being present in the heat-sensitive layer and/or another layer on the same side of the support carrying the heat-sensitive layer, characterized in that said method contains the step of information-wise heating said heat-sensitive layer through a contacting but removable protection element, e.g. web or sheet, wherefrom during said heating no transfer of imaging substance(s) to said heat-sensitive layer takes place.

SHORT DESCRIPTION OF THE DRAWING

FIG. 1 represents a cross-sectional view of a direct thermal print arrangement operating according to a particular mode of the present invention with a re-usable protection web preventing during scanningwise and pixelwise heating of the recording material its direct contact with a thermal printhead.

DETAILED DESCRIPTION OF THE INVENTION

Figure 1:
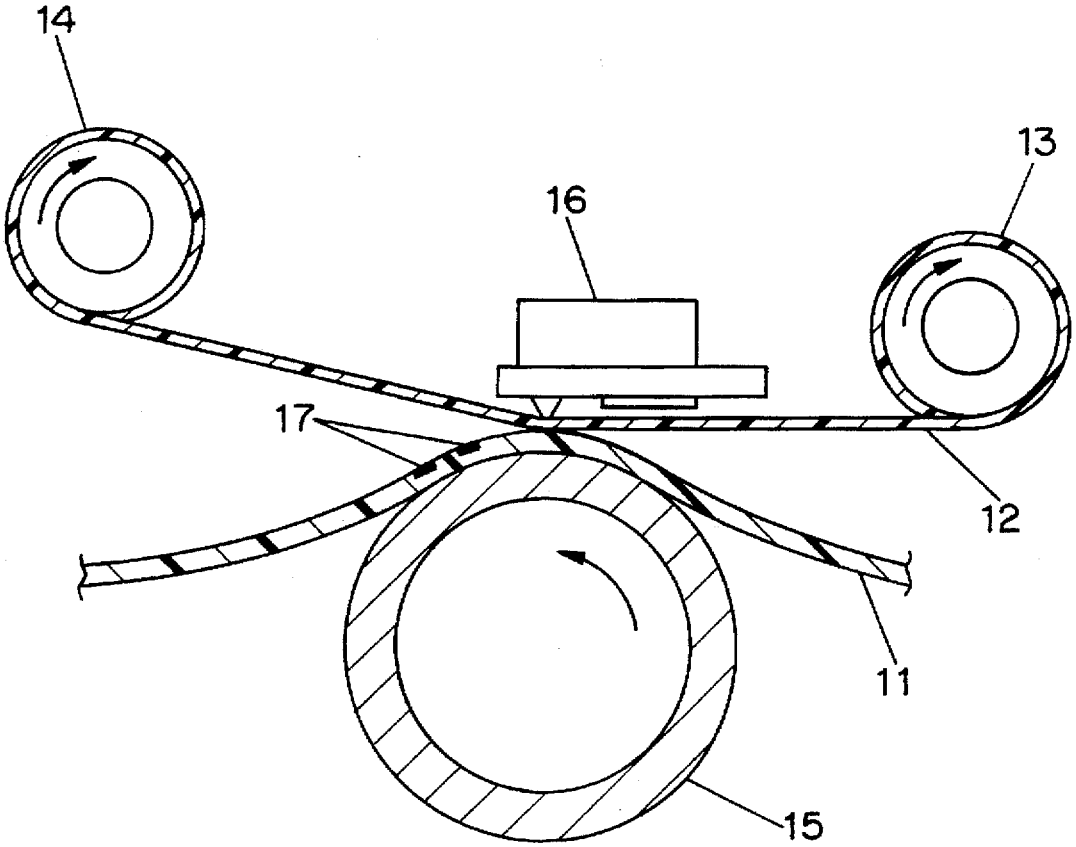

The information-wise heating proceeds by means of a thermal printhead containing tiny selectively electrically energized resistors.

A survey of printhead requirements is given in the already mentioned Handbook of Imaging Materials, Chapter 11, p. 510–514.

Commercially available thermal printheads are e.g. a Fujitsu Thermal Head (FTP-040 MCS001), a TDK Thermal Head F415 HH7-1089, and a Rohm Thermal Head KE 2008-F3 and Kyocera Thermal Head KST-219-12 MPG 27.

The image signals for modulating the heat produced by means of the thermal printhead are obtained either directly from opto-electronic scanning devices or from an intermediary storage means, e.g. magnetic disc or tape or optical disc storage medium, optionally linked to a digital image work station wherein the image information can be processed to satisfy particular needs.

Direct thermal imaging can be used for both the production of transparencies and reflection type prints having an opaque white light reflecting background.

In the hard copy field recording materials on white opaque base, e.g. paper base are used. Said base and/or a layer between the recording layer may contain white light reflecting pigments.

Black-and-white transparencies are widely used in the medical diagnostic field in inspection techniques operating with a light box.

According to a preferred embodiment the protection element used in conjunction with the direct thermal recording material is a flexible element made of (an) organic resin(s) or resin coated material.

Any material can be used for manufacturing said protection element provided it can be made thin enough to transmit heat applied on one side to pass into the heat-sensitive layer. During thermal recording the protective element has to be sufficiently dimensionally stable and to possess a low coefficient of friction, preferably lower than 30. The coefficient of friction (COF) is determined as described in published EP-A 0 392 474.

Suitable protection elements are made of organic resin(s), e.g. of polyesters such as polyethylene terephthalate, polyamides, polyimides, polycarbonates, cellulose esters and fluorinated polymers. Preference is given to a sheet or web made of oriented polyethylene terephthalate having high mechanical strength and melting point (Tm) above 260° C.

The thickness of a useful protective sheet, web or belt is e.g. from 2 to 50 μm, but is preferably not thicker than 10 μm.

According to a particular embodiment in order to avoid sticking of the removable protective element to the heating element and/or to the contacting recording layer the protective element being a sheet or web is coated at one or both sides with an anti-sticking or slipping layer.

Suitable slipping layers are e.g. polymer coatings having a low (preferably lower than 30) dynamic coefficient of friction (COF) determined as defined in the already mentioned published EP-A 0 392 474. For obtaining such low dynamic coefficient of friction the slipping layer may comprise lubricating material in liquid or solid form, e.g. a dissolved lubricating material and/or particulate anti-friction material, e.g. talc particles, optionally protruding from said layer.

Examples of other suitable lubricating materials are surface active agents applied with or without a polymeric binder. The surface active agents have a hydrophobic molecule part linked to a polar group(s) e.g. carboxylate, sulfonate, phosphate, aliphatic amine salt or aliphatic quaternary ammonium salt group, or are polyoxyethylene alkyl ethers, polyethylene glycol fatty acid esters or fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters.

Suitable slipping layer compositions are described e.g. in EP 138483, EP 227090, U.S. Pat. Nos. 4,567,113, 4,572,860 and 4,717,711 and in published European patent application 311841.

In an example a suitable slipping layer comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Another suitable slipping layer may be obtained by coating a solution of at least one silicone compound and a substance capable of forming during the coating procedure a polymer having an inorganic backbone which is an oxide of a group IVa or IVb element as described in published European patent application 0554576.

Other suitable slipping (anti-stick) coatings are described e.g. in published European patent applications (EP-A) 0 501 072 and 0 492 411.

A slipping layer may have a thickness of about 0.2 to 5.0 μm, preferably in the range of 0.4 to 2.0 μm.

Suitable organic reducing agents for the reduction of substantially light-insensitive organic silver salts are organic compounds containing at least one active hydrogen atom linked to O, N or C, such as is the case in aromatic di- and tri-hydroxy compounds, e.g. hydroquinone and substituted hydroquinones, catechol, pyrogallol, gallic acid and gallates; aminophenols, METOL (tradename), p-phenylenediamines, alkoxynaphthols, e.g. 4-methoxy-1-naphthol described in U.S. Pat. No. 3,094,417, pyrazolidin-3-one type reducing agents, e.g. PHENIDONE (tradename), pyrazolin-5-ones, indanedione-1,3 derivatives, hydroxytetrone acids, hydroxytetronimides, reductones, and ascorbic acid. Representatives for thermally activated reduction of organic silver salts are described e.g. in U.S. Pat. Nos. 3,074,809, 3,080,254, 3,094,417, 3,887,378 and 4,082,901.

Particularly suited organic reducing agents for use in thermally activated reduction of the substantially light insensitive silver salts are organic compounds containing in their structure two free hydroxy groups (—OH) in ortho-position on a benzene nucleus as is the case in catechol and polyhydroxy spiro-bis-indane compounds corresponding to the following general formula (I):

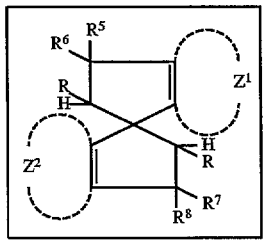

(I)

wherein:

R represents hydrogen or alkyl, e.g. methyl or ethyl, each of $R^5$ and $R^6$ (same or different) represents, an alkyl group, preferably methyl group or a cycloalkyl group, e.g. cyclohexyl group, each of $R^7$ and $R^8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

Particularly useful are the polyhydroxy-spiro-bis-indane compounds described in U.S. Pat. No. 3,440,049 as photographic tanning agent, more especially 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II). Indane is also known under the name hydrindene.

Preferably the reducing agent is added to the heat sensitive layer but all or part of the reducing agent may be added to one or more other layers on the same side of the support as the heat sensitive layer. For example, all or part of the reducing agent may be added to a subbing layer or protective surface layer.

The recording material may contain auxiliary reducing agents having poor reducing power in addition to the main reducing agent described above preferably in the heat sensitive layer containing the organic silver salt. For that purpose preferably sterically hindered phenols are used.

Sterically hindered phenols or bis-phenols as described e.g. in U.S. Pat. Nos. 3,547,648 and 4,001,026 are examples of such auxiliary reducing agents that can be used in admixture with said organic silver salts without premature reduction reaction and fog-formation at room temperature.

Substantially light-insensitive organic silver salts, particularly suited for use in a resin binder of a heat-sensitive recording layer are silver salts of aliphatic carboxylic acids known as fatty acids, wherein the aliphatic carbon chain has at least 12 C-atoms, e.g. silver palmitate, silver stearate and silver behenate, but modified aliphatic carboxylic acids with thioether group as described e.g. in GB-P 1,111,492 may be used likewise to produce a thermally developable silver image.

The weight ratio of resin binder to organic silver salt is e.g. in the range of 0.2 to 6, and the thickness of the recording layer is preferably in the range of 3 to 30 μm, more preferably in the range of 8 to 16 μm.

The silver image density depends on the coverage of the reducing agent(s) and organic silver salt(s) and is preferably such that on heating above 100° C. an optical density of at least 3 can be obtained.

In order to attain such high optical density the recording layer preferably contains at least 0.10 mole of reducing agent(s) per mole of organic silver salt. In particular combinations the fatty acid silver salts are present in combination with the free fatty acids.

In order to obtain a neutral black image tone in the higher densities and neutral grey in the lower densities the recording layer contains in admixture with said organic silver salt and reducing agents a so-called toning agent known from thermography or photo-thermography.

Suitable toning agents are the phthalimides and phthalazinones within the scope of the general formulae described in the already mentioned Re. 30,107. Further reference is made to the toning agents described in U.S. Pat. Nos. 3,074,809, 3,446,648 and 3,844,797. Other useful toning agents are benzoxazine dione compounds, 3,4-dihydro-2,4-dioxo-1,3,2H-benzoxazine described in U.S. Pat. No. 3,951,660.

In addition to said ingredients the recording layer may contain other additives such as antistatic agents, e.g. non-ionic antistatic agents including a fluorocarbon group as e.g. in $F_3C(CF_2)_6CONH(CH_2CH_2O)$-H, ultraviolet light absorbing compounds, white light reflecting and/or ultraviolet radiation reflecting pigments, colloidal silica, and/or optical brightening agents.

As binding agent for said ingredients preferably thermoplastic resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, galactomannan, polymers derived from α,β-ethylenically unsaturated compounds such as polyvinyl chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene. A particularly suitable ecologically interesting (halogen-free) binder is polyvinyl butyral.

The above mentioned polymers or mixtures thereof forming the binder in the thermographic recording layer may be used in conjunction with waxes or "heat solvents" also called thermosolvents improving the reaction speed of the redox-reaction at elevated temperature.

By the term "heat solvent" in this invention is meant a non-hydrolyzable organic material which is in solid state in the recording layer at temperatures below 50° C. but becomes a liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

The support for the heat-sensitive recording material is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and may be subbed for improving the adherence thereto of the recording layer.

The coating of the recording layer composition may proceed by any coating technique known in the art using a solvent or solvent mixture for the coating ingredients.

According to a first embodiment of the method according to the present invention the protective element is used in conjunction with a direct thermal recording material in the form of a resin web. The protective resin web replaces in a common thermal dye diffusion transfer apparatus the dye donor material, is delivered from a supply roller and is taken up after its contact with the printhead on a collector roller. The collector roller after reaching its full load is moved in the apparatus to become the supply roller, and the emptied supply roller is replacing the moved collector roller. Said embodiment is illustrated in the following Example 1 wherein reference is made to the accompanying drawing.

According to a second embodiment the protective resin element is applied in the form of an endless belt driven synchronously in contact with a direct thermal recording material.

According to a third embodiment a protective resin sheet is applied by lamination, but is not adhering that strong to the recording layer that it cannot be peeled off anymore in succession to the thermal recording step.

Said embodiment is illustrated in Example 2.

The examples illustrate the present invention without however limiting it thereto.

EXAMPLE 1

A direct thermal recording material was prepared as follows:

A subbed polyethylene terephthalate support having a thickness of 100 μm was doctor blade-coated so as to obtain thereon after drying the following recording layer including:

| | |
|---|---|
| silver behenate | 5 g/m$^2$ |
| polyvinyl butyral | 2.5 g/m$^2$ |
| behenic acid | 0.46 g/m$^2$ |
| reducing agent S as defined hereinafter | 0.95 g/m$^2$ |
| 3,4-dihydro-2,4-dioxo-1,3,2H-benzoxazine | 0.36 g/m$^2$ |
| silicone oil | 0.02 g/m$^2$ |

Reducing agent S is a polyhydroxy spiro-bis-indane, viz. 3,3,3',3'-tetramethyl-5,6,5',6'-tetrahydroxy-spiro-bis-indane.

As illustrated in the accompanying drawing a rotably driven drum 15 supports and guides the direct thermal recording web material 11. The recording layer of said material 11 intimately contacts a protective web material 12 which is delivered by an unwinding roller 13 and during thermal printing is taken up continuously by a take-up winding roller 14.

The protective web material 12 is a biaxially stretched polyethylene terphthalate web having a thickness of 5 μm and a width of 12 cm.

The side of said protective web material 12 opposite to said drum 15 contacts a stationary thermal printhead 16 which is pressed under controlled tension against the protective web material 12.

The protective web 12 travels synchronously with the recording material web 11 into the same direction.

After its information-wise heating the recording web 11 containing image markings 17 is cut (not shown in the drawing) into sheets of 110 mm×110 mm format.

The optical densities of the imaged and non-imaged areas were measured through ortho-filter with densitometer MACBETH TD 904 (tradename). The minimum optical density ($D_{min}$) was 0.07 and the maximum optical density ($D_{max}$) was 3.8.

EXAMPLE 2

A recording web material as described in Example 1 was put through a roller laminator with its thermosensitive layer in contact with a protective web of polyethylene terephthalate having a thickness of 5 μm.

The roller laminator consisted of a smoot steel roller having a temperature of 80° C. and a hard rubber pressure roller forming a nip wherethrough the laminate was led at a speed of 50 cm per minute. The web laminate was cut into sheets for use in thermal recording.

The recording proceeded with a MITSUBISHI CP100 (tradename) thermal printer having the thermal printhead in contact with the 5 μm thick protective sheet. Following the thermal recording the protective sheet was peeled off by hand.

The maximum optical density obtained in the recording material was 3.2 and the minimum density was 0.09.

We claim:

1. A direct thermal imaging method wherein in conjunction with an information-wise energized thermal printhead a direct thermal recording material is used that contains on a support (i) a heat-sensitive layer comprising a substantially light insensitive organic silver salt, (ii) optionally an outermost anti-friction or protective layer, and (iii) a reducing agent being present in the heat-sensitive layer and/or another layer on the same side of the support carrying the heat-sensitive layer, characterized in that said method contains the step of information-wise heating said heat-sensitive layer through a contacting but removable protection element having a form selected from the group consisting of a web, a sheet, or a belt wherefrom during said heating no transfer of imaging substance(s) to said heat-sensitive layer takes place.

2. Direct thermal imaging method according to claim 1, wherein said protection element is a flexible element made of (an) organic resin(s) or resin coated material.

3. Direct thermal imaging method according to claim 2, wherein said resin is a polyester, polyamide, polyimide, polycarbonate, cellulose ester or fluorinated polymer.

4. Direct thermal imaging method according to claim 3, wherein said polyester is polyethylene terephthalate.

5. Direct thermal imaging method according to claim 1, wherein said element is in the form of sheet, web or belt having a thickness from 2 to 50 μm.

6. Direct thermal imaging method according to claim 1, wherein in order to avoid sticking of the removable protective element to the printhead or to a contacting layer the protective element being a sheet or web is coated at one or both sides with an anti-sticking or slipping layer.

7. Direct thermal imaging method according to claim 6, wherein said slipping layer is a polymer coating comprising a dissolved lubricating material and/or particulate anti-friction material.

8. Direct thermal imaging method according to claim 1, wherein said information-wise heating proceeds by means of a thermal head containing tiny selectively electrically energized resistors contacting said protection element.

9. Direct thermal imaging method according to claim 1, wherein in said heat-sensitive layer the weight ratio of resin binder to said organic silver salt is in the range of 0.2 to 6, and the thickness of said heat-sensitive layer is in the range of 3 to 30 μm.

* * * * *